US007438113B2

(12) United States Patent
Pon

(10) Patent No.: US 7,438,113 B2
(45) Date of Patent: Oct. 21, 2008

(54) WINDOW COVERING HAVING OPERABLE SEGMENTS

(75) Inventor: David Pon, Irvine, CA (US)

(73) Assignee: Nien Made Enterprise Co., Ltd., Taichung, Taiwan (CN)

( * ) Notice: Subject to any disclaimer, the term of this patent is extended or adjusted under 35 U.S.C. 154(b) by 328 days.

(21) Appl. No.: 10/995,713

(22) Filed: Nov. 23, 2004

(65) Prior Publication Data

US 2005/0155721 A1 Jul. 21, 2005

(51) Int. Cl.
*E06B 3/48* (2006.01)

(52) U.S. Cl. ..... 160/84.01; 160/180; 160/116; 160/113

(58) Field of Classification Search ..... 160/84.01, 160/180, 116, 113, 167 R
See application file for complete search history.

(56) References Cited

U.S. PATENT DOCUMENTS

| | | | | | |
|---|---|---|---|---|---|
| 3,490,515 | A | | 1/1970 | Kandel | |
| 5,787,951 | A | * | 8/1998 | Tonomura et al. | 160/84.01 |
| 5,829,506 | A | | 11/1998 | Zorbas | |
| 5,839,494 | A | * | 11/1998 | Judkins | 160/167 R |
| 6,006,812 | A | * | 12/1999 | Corey | 160/84.05 |
| 6,105,657 | A | | 8/2000 | Zorbas | |
| 6,371,191 | B1 | * | 4/2002 | Woodring | 160/168.1 R |
| 6,530,413 | B2 | * | 3/2003 | Hwang | 160/84.03 |
| 6,792,994 | B2 | * | 9/2004 | Lin | 160/84.03 |
| 6,932,138 | B2 | * | 8/2005 | Yu et al. | 160/84.01 |
| 7,021,359 | B2 | * | 4/2006 | Yu et al. | 160/84.04 |
| 2004/0216851 | A1 | | 11/2004 | Yu et al. | |
| 2005/0155722 | A1 | * | 7/2005 | Colson et al. | 160/89 |

* cited by examiner

*Primary Examiner*—Katherine Mitchell
*Assistant Examiner*—Candace L. Bradford
(74) *Attorney, Agent, or Firm*—Buchanan Ingersoll & Rooney PC

(57) ABSTRACT

A window covering has a headrail, a plurality of lift cords extending from the headrail and a plurality of shade elements positioned sequentially below the headrail. Each shade element has an upper edge and a lower edge which edges are substantially parallel to one another and oriented transverse to the lift cords. The shade elements are positioned so that when the shade elements are in a closed position the lower edge of one shade element abuts the upper edge of an adjacent shade element and when the shade elements are in an open position, the lower edge of the at least one shade element is spaced apart from the upper edge of an adjacent shade element. A first cord is attached to the upper edge of each shade element and a second cord is attached to the lower edge of each shade element. These cords extend to or into the headrail and allow the upper edge of one or more shade elements and the lower edge of an adjacent shade element to be moved away from one another to create a gap between adjacent shade elements through which light may pass. In one embodiment these cords are in a common plane. In another embodiment the first cord is spaced apart from the second cord at a distance less than the width of the shade segments. The window covering may be configured for top down, bottom up operation.

45 Claims, 12 Drawing Sheets

WINDOW COVERING HAVING OPERABLE SEGMENTS

BACKGROUND OF THE INVENTION

1. Field of the Invention

The present invention relates generally to window blinds of the type operated by lift cords and made of flexible window covering material such as a roman shade or pleated shade.

2. Description of the Related Art

Various vertical window blinds including venetian blinds, roller shades, roman shades, and the like are known. These window blinds commonly comprise a headrail, a bottom rail and a window covering material extending between them. Lift cords extend from the bottom rail into the headrail for raising and lowering the blind. The window covering material may be pleated or cellular material, woven woods or grasses or roman shade material that is raised and lowered or slats on ladders that can be raised and lowered as well as tilted for light control.

A venetian blind provides the widest range of light control. The slats can be raised to a fully open position, lowered to cover the entire window and tilted vertically to a fully closed position or lowered to a fully lowered or partially lowered position with the slats tilted at a selected orientation between vertical and horizontal. Roman, pleated and cellular shades have a softer appearance than venetian blinds. However, a conventional roman shade and other fabric shades can only be raised and lowered to cover all or a portion of the window. When a roman shade is in a fully lowered or partially lowered position, it cannot be controlled or adjusted to change the amount of light transmittance as occurs when one tilts the slats in a fully lowered or partially lowered venetian blind.

Although the slats in most venetian blinds are wood, aluminum or plastic, it is known to make fabric slats. One example of a fabric slat is disclosed in U.S. Pat. No. 5,829,506 to Zorbas. Like wood, aluminum and plastic slats fabric slats are hung on ladders or attached to ladder rungs and may have transverse stiffeners. Venetian blinds having fabric slats operate in the same manner as venetian blinds having wood, aluminum or plastic slats.

SUMMARY OF THE INVENTION

I provide a window covering having a headrail, two or more lift cords extending from the headrail and several operable shade elements or segments positioned sequentially below the headrail. Each shade element has at least one aperture through which one of the lift cords passes. The upper edge and lower edge of each shade segment are substantially parallel to one another and oriented transverse to the lift cords. The shade elements are positioned so that when the shade elements are in a closed position the lower edge of at least one shade element abuts the upper edge of an adjacent shade element. When the shade elements are in an open position, the lower edge of the at least one shade element is spaced apart from the adjacent shade element. Movement of the shade elements is controlled by a first cord or cords attached to the upper edge of each shade element and extending into the headrail and a second cord or cords attached to the lower edge of each shade element. In one embodiment pulling the second cord raises the lower edge of each shade segment creating a gap between shade segments. In another embodiment releasing the first cord causes the upper edge of each shade element to fall creating a gap between shade segments. Another alternative is to connect both cords to a drum or shaft which when rotated will move the edges of each shade segment together to create the gap. In yet another embodiment the first cord or second cord are attached to alternate shade segments so that movement of the cord raises or lowers some but not all of the shade segments.

In yet another embodiment the shade elements are sized and the cords are attached to the shade elements so that continued movement of at least one of the cords will cause the shade elements to flip. In this embodiment I may provide a color, pattern, texture or material on one side that is different from the color, pattern, texture or material on the opposite side of the shade elements. Then the user may adjust the window covering to cause either one side of the other side to face the room.

One may also configure the present shade as a top down, bottom up shade. In one embodiment of this type of shade all the cords pass through cord locks allowing the shade segments to be lowered and stacked on a bottomrail or window sill. Another embodiment of a top down, bottom up shade uses an intermediate rail. The cords that attach to the upper and lower edges of the shade segments are attached to or pass through the intermediate rail.

Other objects and advantages of the present window covering will become apparent from certain present preferred embodiments thereof shown in the drawings.

DETAILED DESCRIPTION OF THE INVENTION

Figure 1:
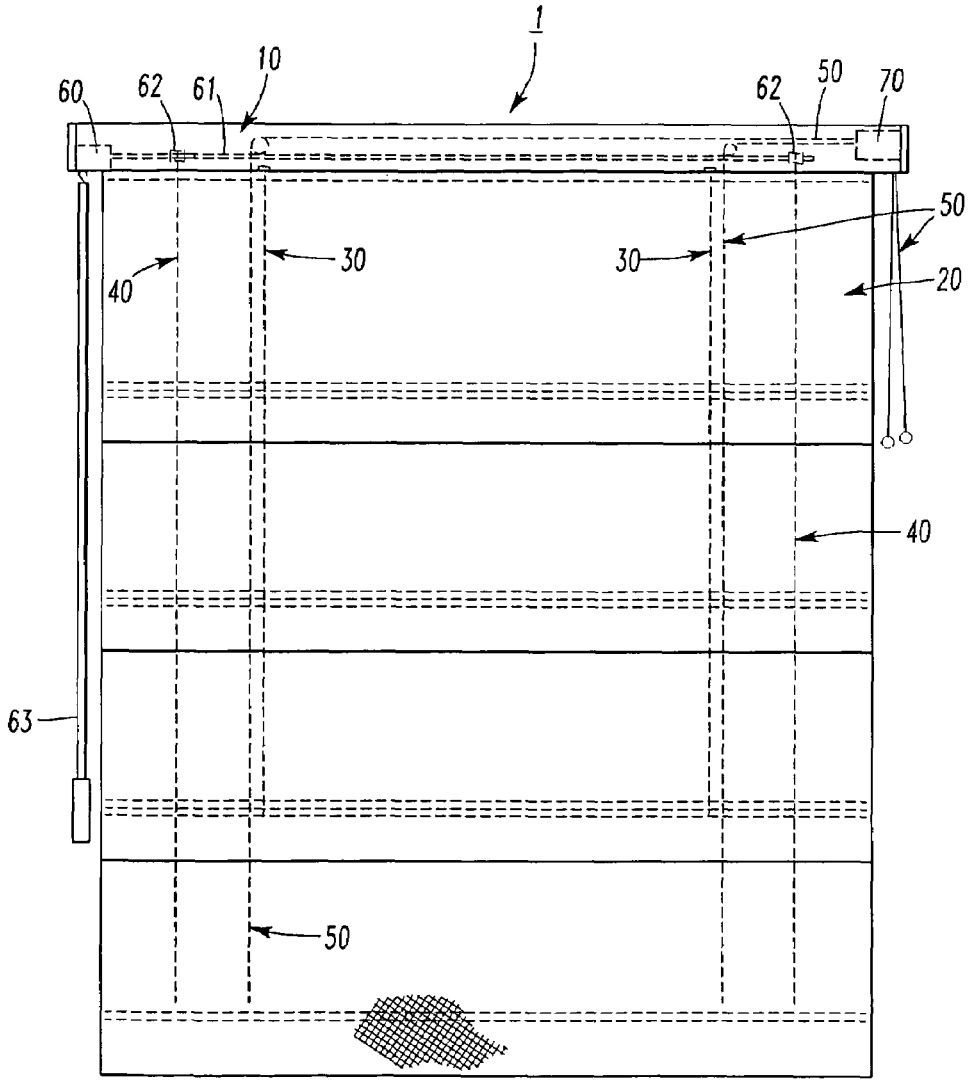
FIG. 1 is a front view of a first preferred embodiment of the present invention.

A first present preferred embodiment is in the form of a roman shade and is shown in FIGS. 1 thru 7. This roman shade 1 is comprised of a headrail 10, a plurality of operable shade elements or segments 20, two first cords 30, two second cords 40 and two lift cords 50, all of which extend into the headrail. Each shade element has a first or upper edge to which a first stiffening rod 21 is attached, and a second or lower edge to which a second stiffening rod 22 is attached. The rods 21 and 22 extend the full width of the operable shade element. In the first preferred embodiment, the operable shade elements are made of a material of the type used in roman shades. This could be a woven or non-woven fabric or a film. If desired, woven woods or woven grasses could be used.

Figure 2:
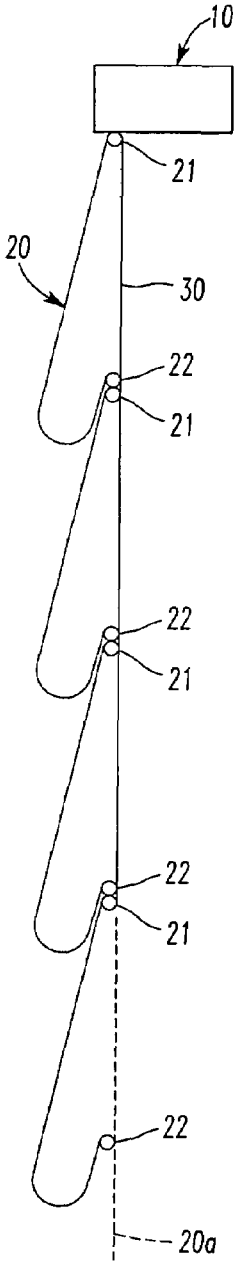
FIG. 2 is a side view of the embodiment of FIG. 1 showing only the connection between the first cord or cords and the operable shade elements.
Figure 3:
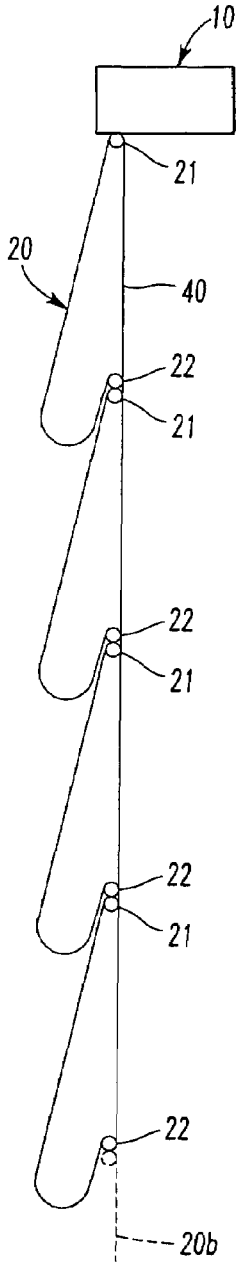
FIG. 3 is a side view of the embodiment of FIG. 1 showing only the connection between the second cord or cords and the operable shade elements.
Figure 6:
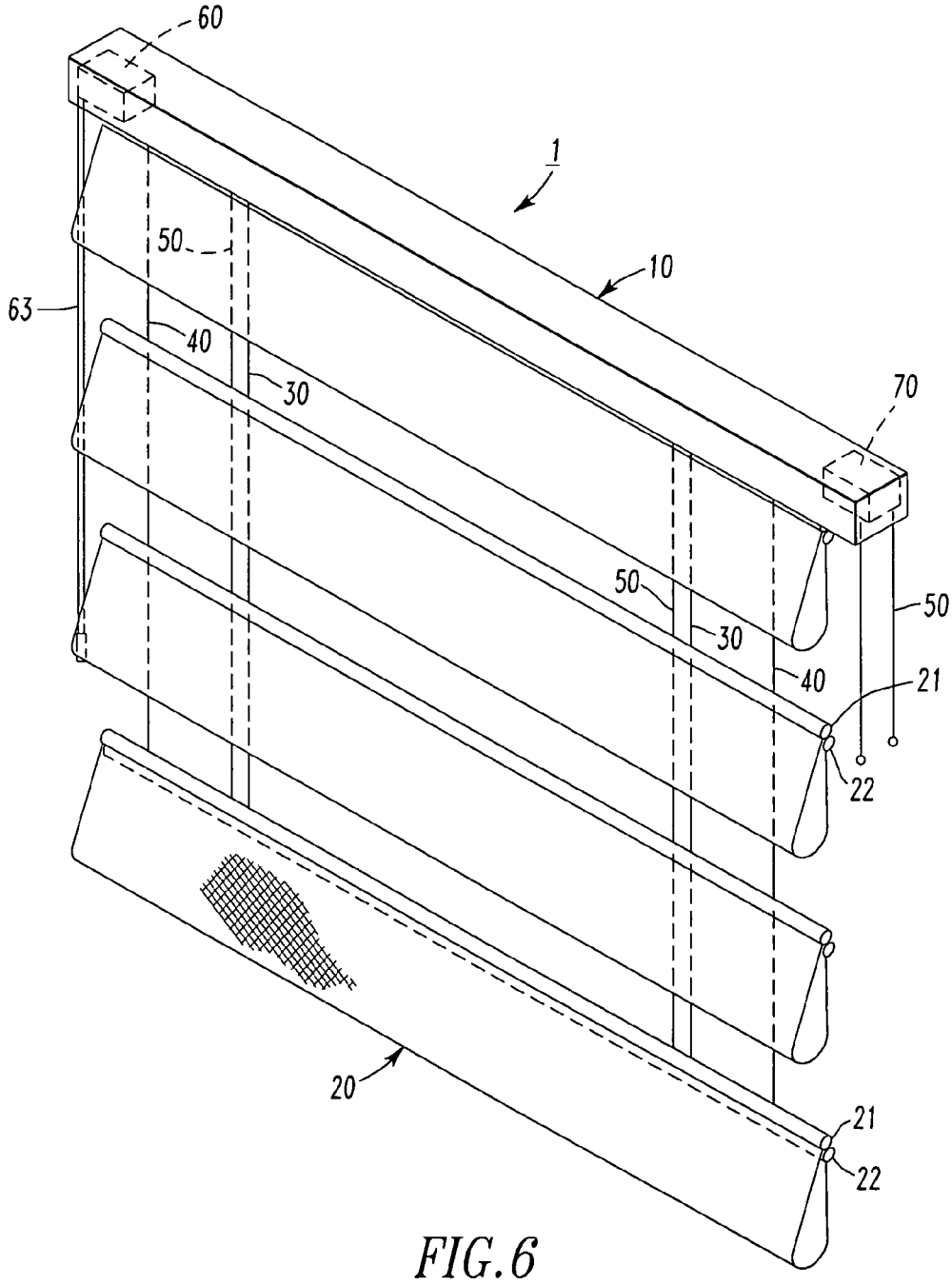
FIG. 6 is a perspective view of the embodiment of FIG. 1 in a fully lowered fully open position.
Figure 7:
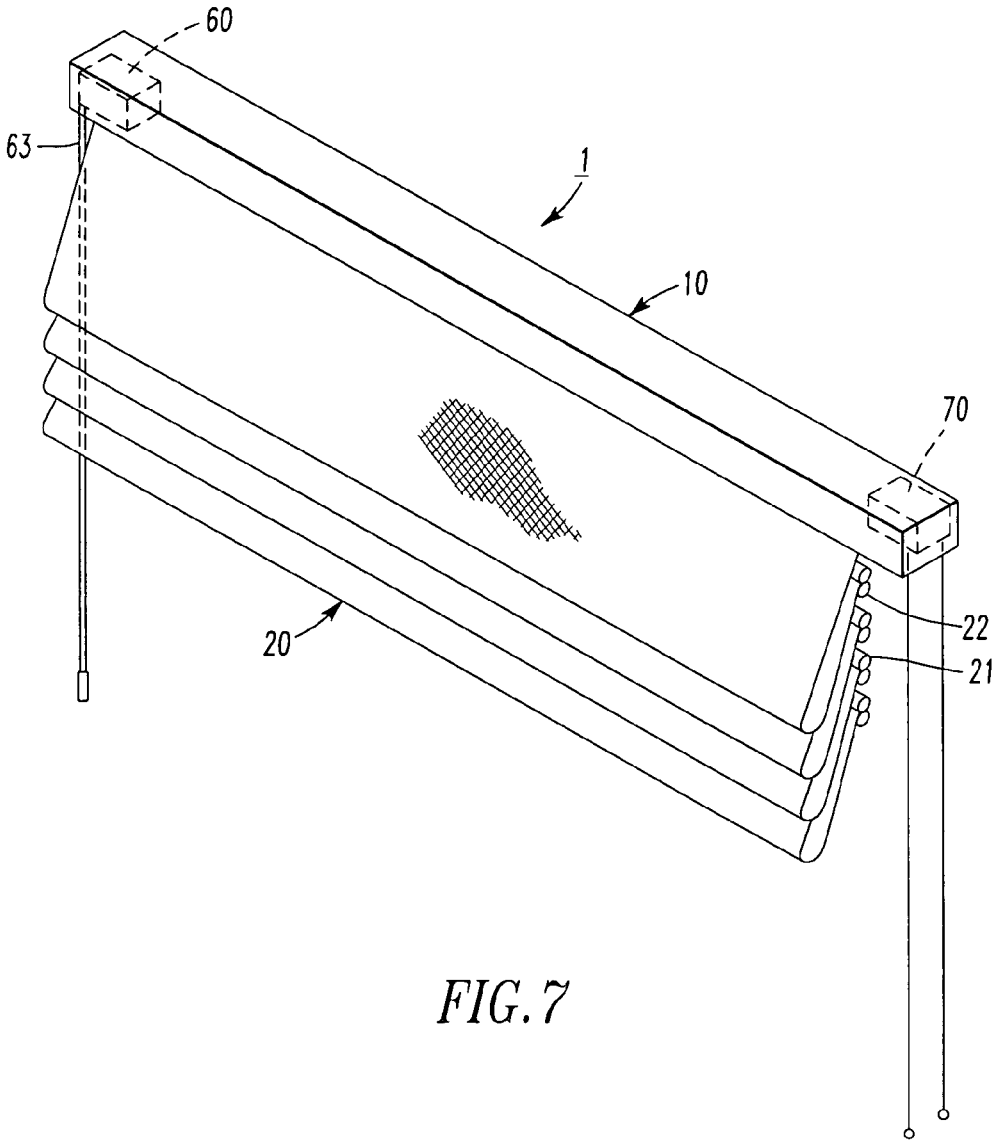
FIG. 7 is a perspective view of the embodiment of FIG. 1 in a fully raised position.

The two first cords 30 are attached to the upper rods 21 of each shade element as shown in FIG. 2. The upper end of these cords may be fixed to the headrail 10, as shown in FIG. 1, or may be connected to a drum or other operating mechanism within the headrail 10. The second cords 40 are attached to the rods 22 on the lower edge of each shade member as shown in FIG. 3. Referring now to FIG. 1, the upper ends of the second cords 40 are attached to an operating mechanism comprised of shaft 61, gear box 60 and control rod or wand 63. Turning the wand will turn shaft 61, winding cords 40 onto respective spools 62 on shaft 61. This will raise the lower edge of each shade segment 20 creating a gap between adjacent shade elements as shown in FIG. 6. Rotating the wand 63 and shaft 61 in an opposite direction will unwind the cords 40 closing that gap. The size of the gap is determined by how much the lower edge is raised. If desired, one could fix the upper ends of cords 40 to the headrail and attach the upper ends of cords 30 to rod 61. Then the shade would be moved to a fully lowered, fully open position by lowering the upper edges of each cord segment. Yet, another alternative is to connect both the first cords 30 and the second cords 40 to shaft 61 in a manner so that the upper and lower edges of the shade segments and rods 21 and 22 would move together or move apart from one another depending upon whether the shaft 61 is rotated clockwise or counterclockwise.

Figure 4:
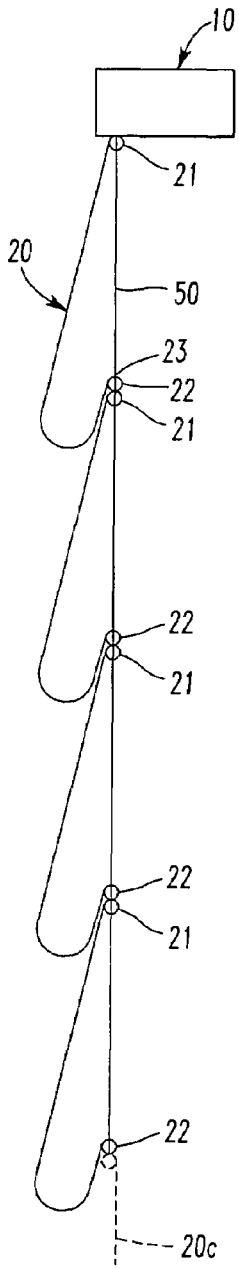
FIG. 4 is a side view of the embodiment of FIG. 1 showing only the connection between the third cord or cords and the shading elements.
Figure 5:
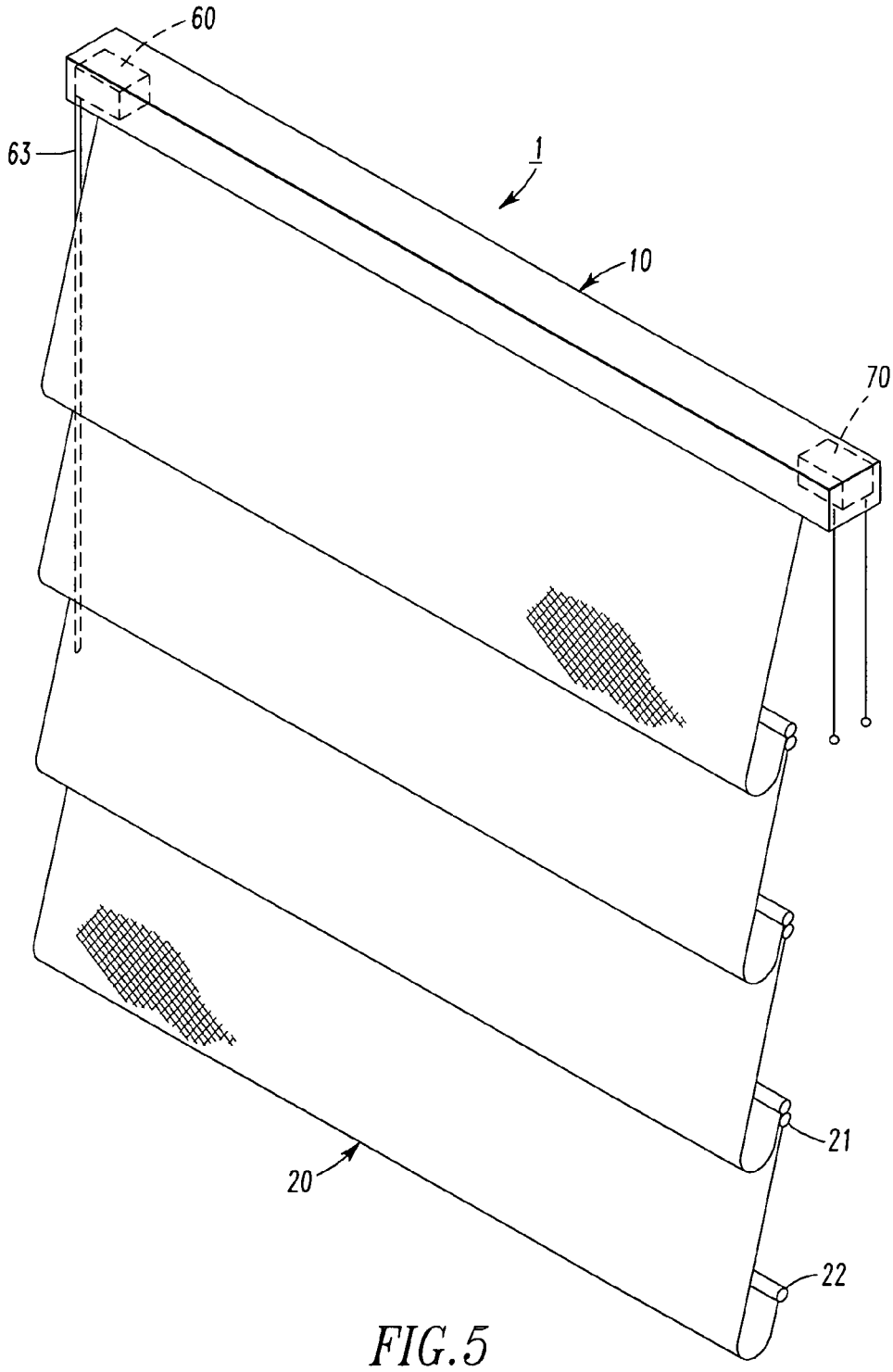
FIG. 5 is a perspective view of the embodiment of FIG. 1 in a fully lowered closed position.

Lift cords 50 extend from the lower edge of the lowermost segment 20 through a cord lock 70 in the headrail 10. Pulling the lift cords 50 will raise the shade to the fully raised position shown in FIG. 7. The lift cords pass behind the shade segments 20, preferably through apertures or loops 23 in all the rods 21, 22 above the lowest rod as shown in FIG. 4. If desired one could wind the lift cords on a shaft within the headrail and use a motor or cord loop to rotate the shaft thereby raising or lowering the shade.

One could provide a bottom shade element to which only the first cords 30, the second cords 40, or the lift cords 50 are attached. The optional bottom segment 20*a*, 20*b* or 20*c*, shown in dotted line in FIGS. 2, 3 and 4, would not fold like the other segments, but would hang like a skirt from the bottom of the window covering.

In all of the cord configurations the first cords 30, second cords 40, and lift cords 50 are On one side of the shade elements 20. Typically, when the window covering is installed this side of the window covering would face the window. As should be apparent from FIGS. 2 through 6, one could draw a plane through any combination of first cords 30 and second cords 40 and that plane would be substantially parallel to the shade elements 20.

In the embodiment shown in FIGS. 1 through 7, the cords 30 and 40 are attached to the edges of the shade segments so that the spacing between the upper and lower edges of each segment is less than the width of the segment between these edges. Because the material in the shade elements 20 is flexible and has no body, each shade segment will fold or droop creating the cascade or waterfall appearance of a conventional roman shade. This waterfall appearance can be seen most clearly in FIGS. 2, 3 and 4. If desired, the cords 30 and 40 could be attached to the shade segments so that the edges of each segment could be moved apart to a distance that is the same as, or close to, the width of the segment to give the shade a flat appearance.

Cords 40 are attached to the lower edge of every shade segment 20 in the embodiment of FIGS. 1 through 7. However, one could connect cord 40 to some, but not all, of the shade segments. Then the lower edges of only those segments would be raised when cord 40 is wound onto the spools 62. Yet another variation would have no lift cords. That blind could be raised by pulling all the cords attached to the upper edges and lower edges of the shade segments into the headrail.

Figure 8:
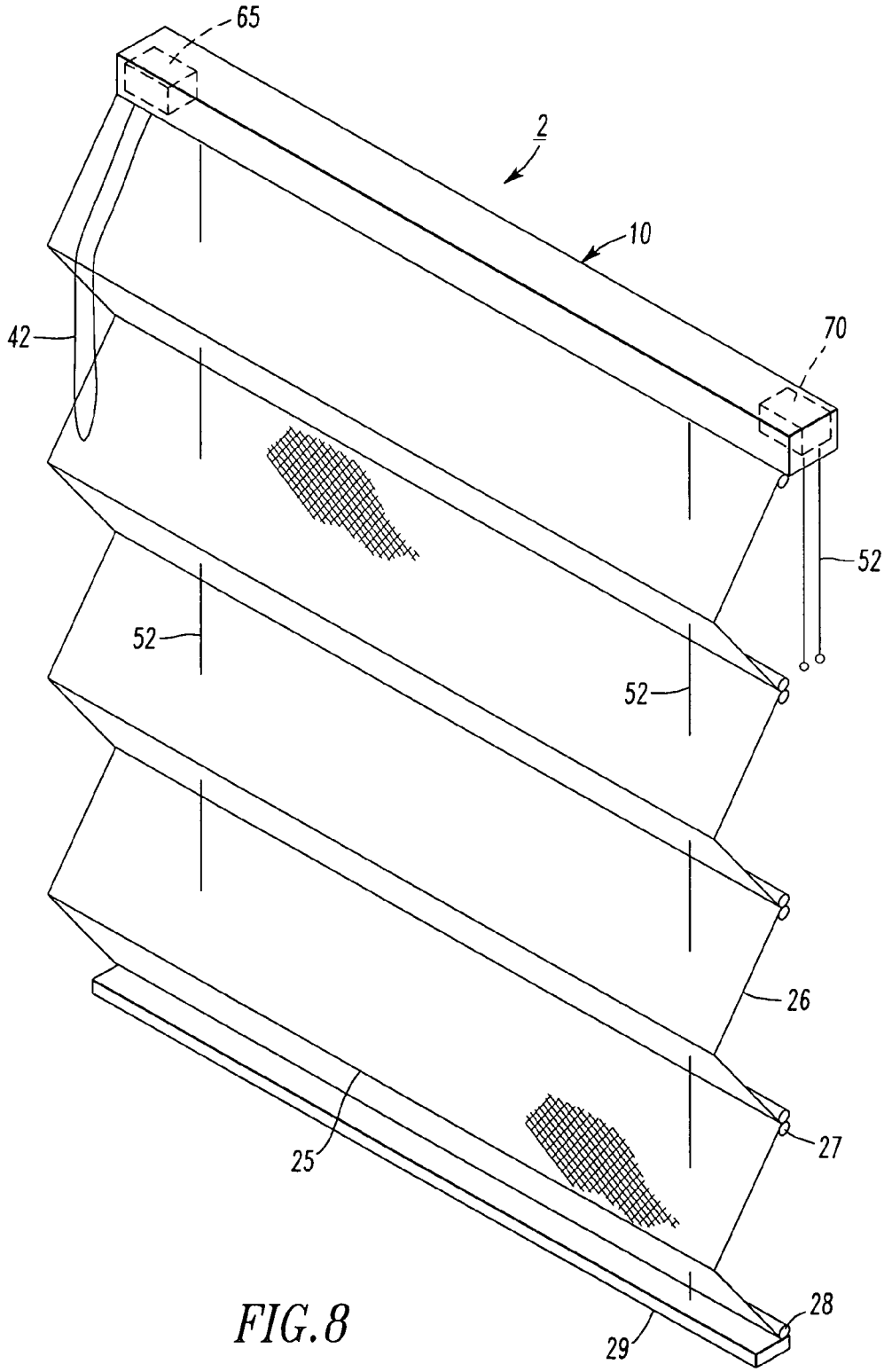
FIG. 8 is a perspective view of a second present preferred embodiment of the present invention in a fully lowered closed position.
Figure 9:
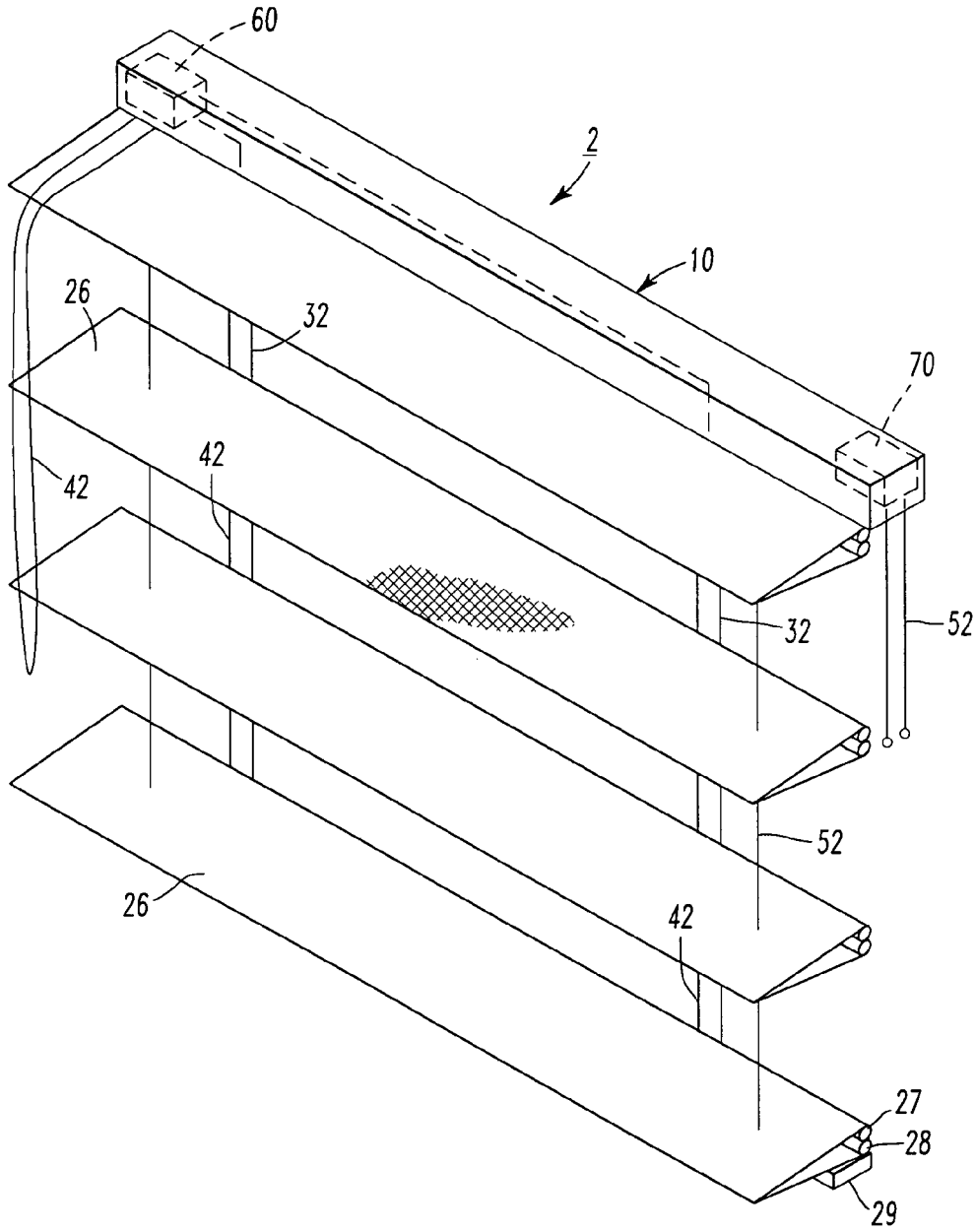
FIG. 9 is a perspective view of the embodiment of FIG. 8 in a fully lowered, fully open position.

In the second present preferred embodiment 2 shown in FIGS. 8 and 9 the shade segments 26 are made of a stiffer material and have a pleat 25. Each shade segment has an upper transverse rod 27 attached to its upper edge and a lower transverse rod 28 attached to its lower edge. Lift cords 52 extend from a bottomrail 29 through the shade segments and into the headrail 10. The lift cords 52 pass through a cord lock 70. Pulling the lift cords will raise the bottomrail 29 causing the shade segments to fold as in a conventional pleated shade. A first pair of cords 32 is attached to the rods 27 along the upper edge of each shade segment. A second pair of cords 42 is attached to the rods 28 on the lower edge of each shade segment. The cords function in the same manner as cords 30 and 40 in the first embodiment. In one configuration shown in dotted line in FIG. 9, cords 42 pass through the headrail 10 and cord lock 65 exiting on one end of the headrail. The upper ends of cords 32 are attached to the headrail. Pulling cords 42 raises the lower edge of the shade segments 26 creating a gap between adjacent segments as shown in FIG. 9. Alternatively, one could fix the upper edges of cords 42 to the headrail and pass cords 32 through the cord lock 65. In this configuration releasing cords 32 will lower the top edges of the shade segments 26 to create a gap between cord segments. Yet, another alternative is to attach the upper ends of cords 32 and 42 to drums on a shaft such that rotation of the shaft would cause the upper and lower edges of each shade segment to move together or move apart.

Each shade segment in the embodiment of FIGS. 8 and 9 has a single pleat. However, one could provide multiple pleats on each segment to cause the segment to take on a desired shape as the upper edge and lower edge of the segment are moved together.

Figure 10:
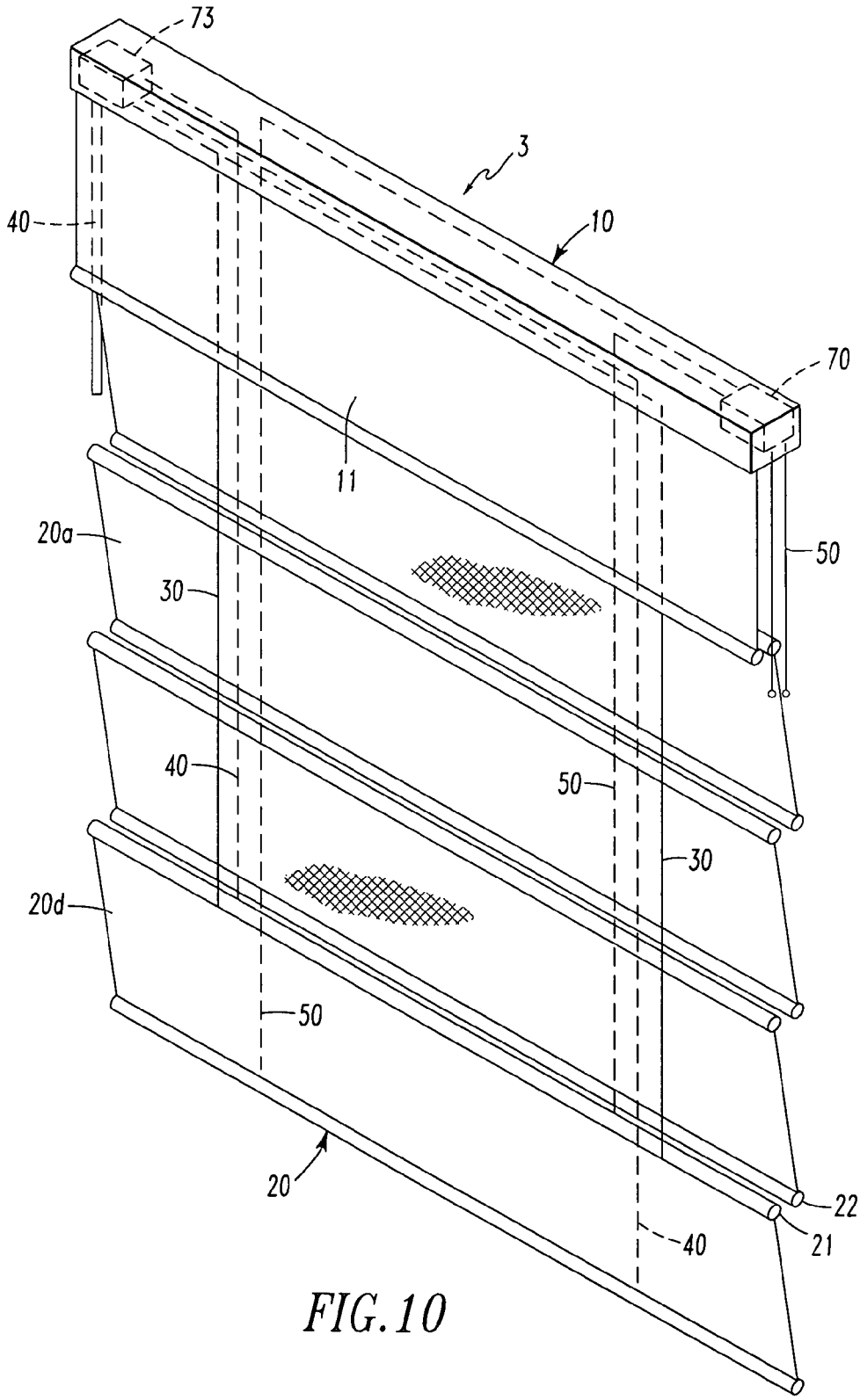
FIG. 10 is a perspective view of a third present preferred embodiment in a fully lowered, closed position.
Figure 11:
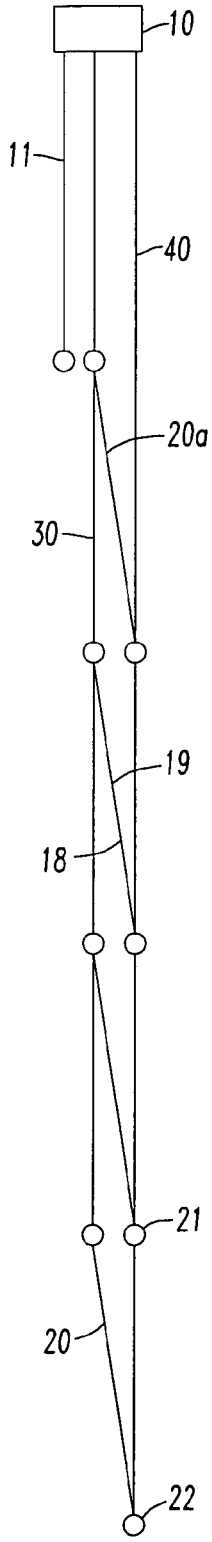
FIG. 11 is a side view of the embodiment shown in FIG. 10.
Figure 12:
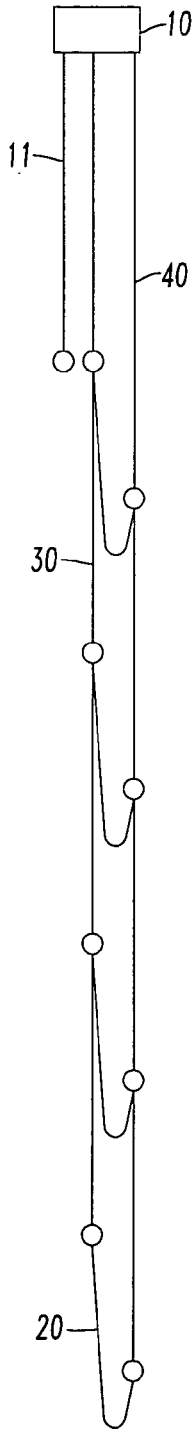
FIG. 12 is a side view similar to FIG. 11 of the embodiment shown in FIG. 10 in a fully lowered, partially open position
Figure 13:
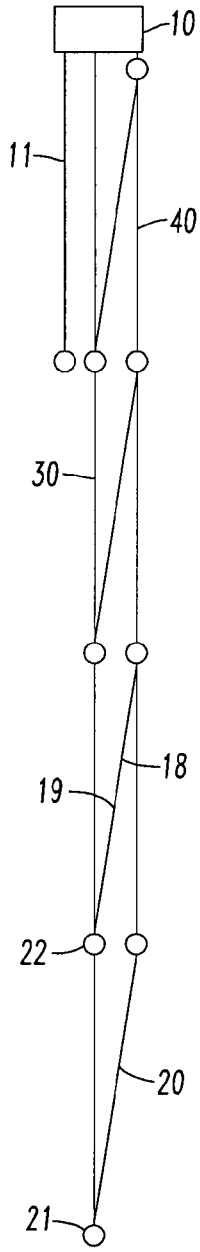
FIG. 13 is a side view similar to FIGS. 11 and 12 after the shade elements have been reversed.

A third present preferred embodiment 3, shown in FIGS. 10, 11, 12 and 13 has a headrail 10 with a valance 11. Like the first embodiment this embodiment has a plurality of shade segments 20, first cords 30, second cords 40 and lift cords 50. Rods 21 and 22 are attached to the upper and lower edges of each shade segment 20. The first cords 30 are attached at their upper ends to the headrail in a manner so that the end of the cords are fixed relative to the headrail. These cords 30 are also attached to the upper edges or upper rods 21 of each shade segment. In this embodiment the upper edge and upper rod of the uppermost segment 20*a* are spaced apart from the headrail 10. Second cords 40 are attached to the lower edge of each shade segment. The upper end of the cords 40 pass through cord lock 73 and exit the headrail. As can be best seen in FIGS. 11, 12 and 13, cords 30 are substantially parallel to cords 40. The distance between adjacent pairs of cords is less than the width of the shade segments. Each shade segment has a first side 18 and a second side 19. These sides face in opposite directions. For example, the window covering 3 can be hung so that the first side 18 will face the room while the second side 19 faces the window when the shade segments are positioned as shown in FIGS. 10, 11 and 12. By pulling the second cords 40 the lower edge of each segment 20 can be raised to the position shown in FIG. 12 and then continue to be raised to a position similar to the position of the shade segments 20 shown in FIG. 6. Because the shade elements are made of a flexible material and have no transverse stiffness they will fold like a roman shade when the cords are positioned as in FIG. 12. Continued pulling of cords 40 will cause the shade elements 20 to flip and be positioned as shown in FIG. 13. Now the first side 18 faces the window and the second side 19 faces the room. In preferred embodiments the two sides 18 and 19 differ in appearance. The differences may be the color, texture or pattern of the fabric or the shade segments can be made of two materials, one material forming the first side and the second material forming the second side. Thus, the user can change the appearance of the window covering as seen from the room and as seen from outside the window. In this embodiment, lift cords 50, shown only in FIG. 10, are attached to the lowermost segment 20*d*. The lift cords 50 pass through a second cord lock 70 on the opposite end of the headrail 10.

It should be apparent from FIGS. 11, 12 and 13 that one could attach cords 30 and 40 to the shade elements so that shade elements 20 overlap. For purposes of the present application one can consider the upper edge of one shade element to abut the lower edge of and adjacent shade elements when the two edges are beside one another as shown in the drawings or when the shade elements overlap and these edges are spaced apart from one another. The cords could be adjusted so that the upper edge of one shade element is opposite the lower edge of an adjacent shade element when the shade elements are shaped as in FIG. 12. Then the window covering would have the appearance of a roman shade, similar to the window covering illustrated in FIG. 5.

Figure 14:
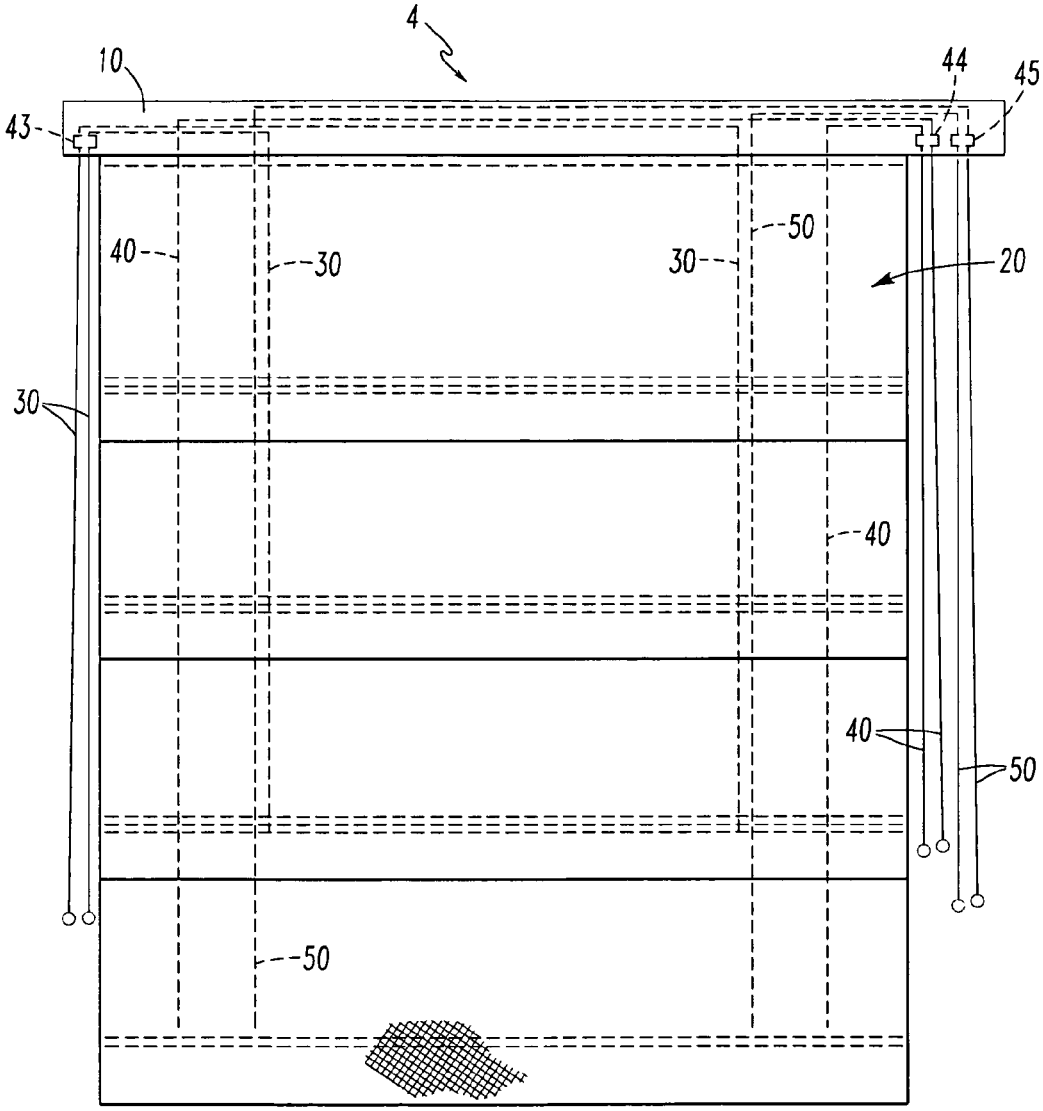
FIG. 14 is a front view of a fourth present preferred embodiment corded to operate as a top down, bottom up shade.

A fourth embodiment of the window covering 4 shown in FIG. 14 is corded to operate as a top down, bottom up blind. This embodiment has the same shade elements 20, preferably having a rod attached to the upper edge of each shade element and a second rod attached to the lower edge of each shade element as in the first embodiment. Moreover, cords 30, 40 and 50 are connected to the shade elements 20 in the same manner as in the front embodiment. Unlike the first embodiment, the fourth embodiment has three cord locks 43, 44 and 45 through which cords 30, 40 and 50 pass. Since none of the cords are fixed to the headrail 10, one can lower the shade segments to fold and rest upon a bottom rail or window sill.

Figure 15:
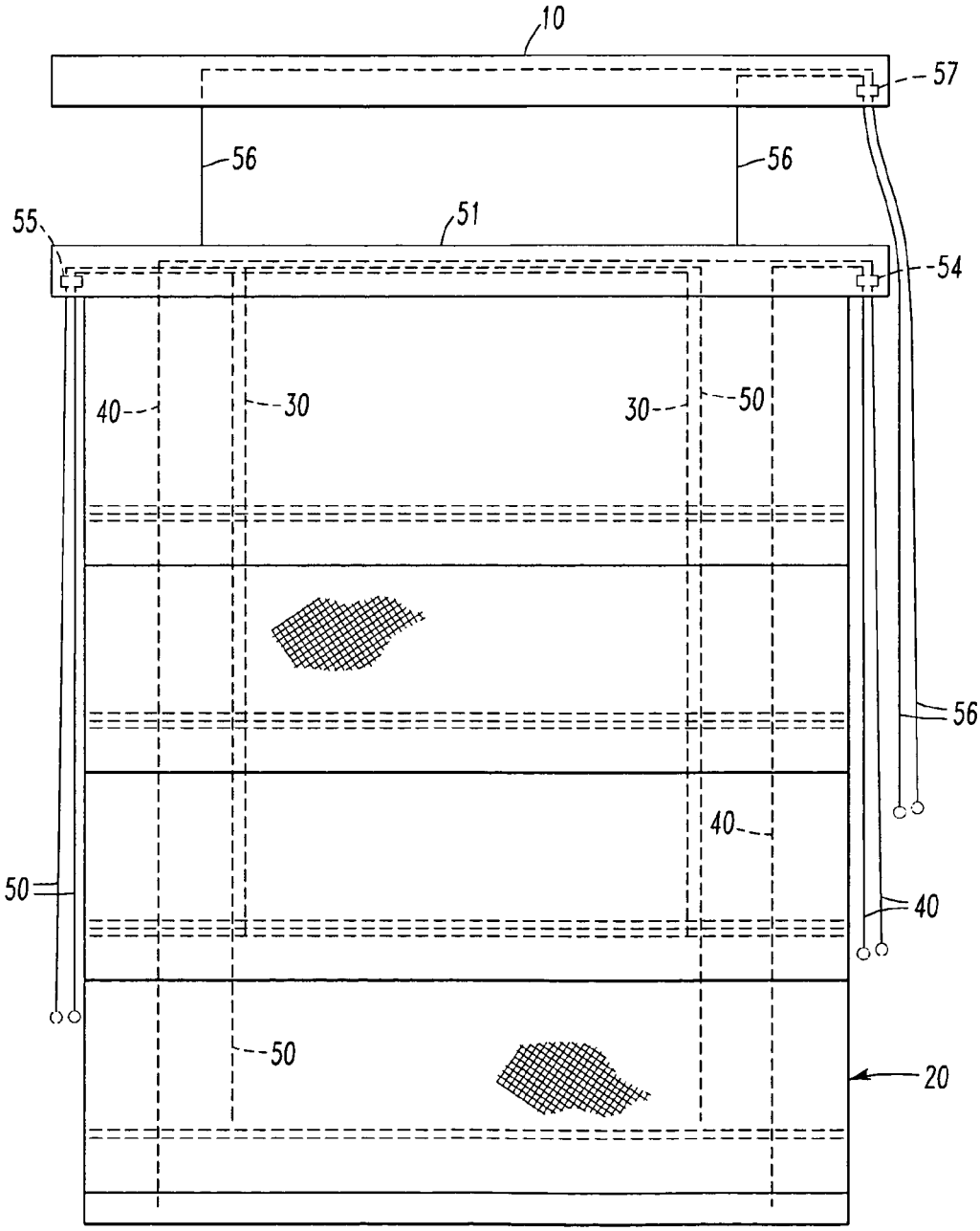
FIG. 15 is a front view of a fifth present preferred embodiment having an intermediate rail showing the intermediate rail partially lowered.

One could also provide top down bottom up capability through the use of another headrail or an intermediate rail 51 as in the fifth embodiment 5 shown in FIG. 15. In this embodiment, the shade segments 20 are similar to the shade elements of the first and fourth embodiments. Cords 30 are attached to the upper edge of each shade element and have their upper ends affixed to the intermediate rail 51. Cords 40 pass through the intermediate rail 51 and through a cord lock 54 at one end of the intermediate rail 51. If desired, cord locks 54 and 55 could be positioned in the headrail 10 in which case cords 40 and 50 would pass through the intermediate rail and into the headrail. In either configuration the cords would operate the shade segments in the same way. Cords 56 are attached to the intermediate rail and pass through a cord lock 57 in the headrail. These cords permit the intermediate rail 51 to be raised and lowered.

Although FIGS. 14 and 15 illustrate present preferred cording arrangements for top down, bottom up operation the alternative configurations for attaching and operating the cords disclosed in the context of the first embodiment could be used in these embodiments.

Figure 16:
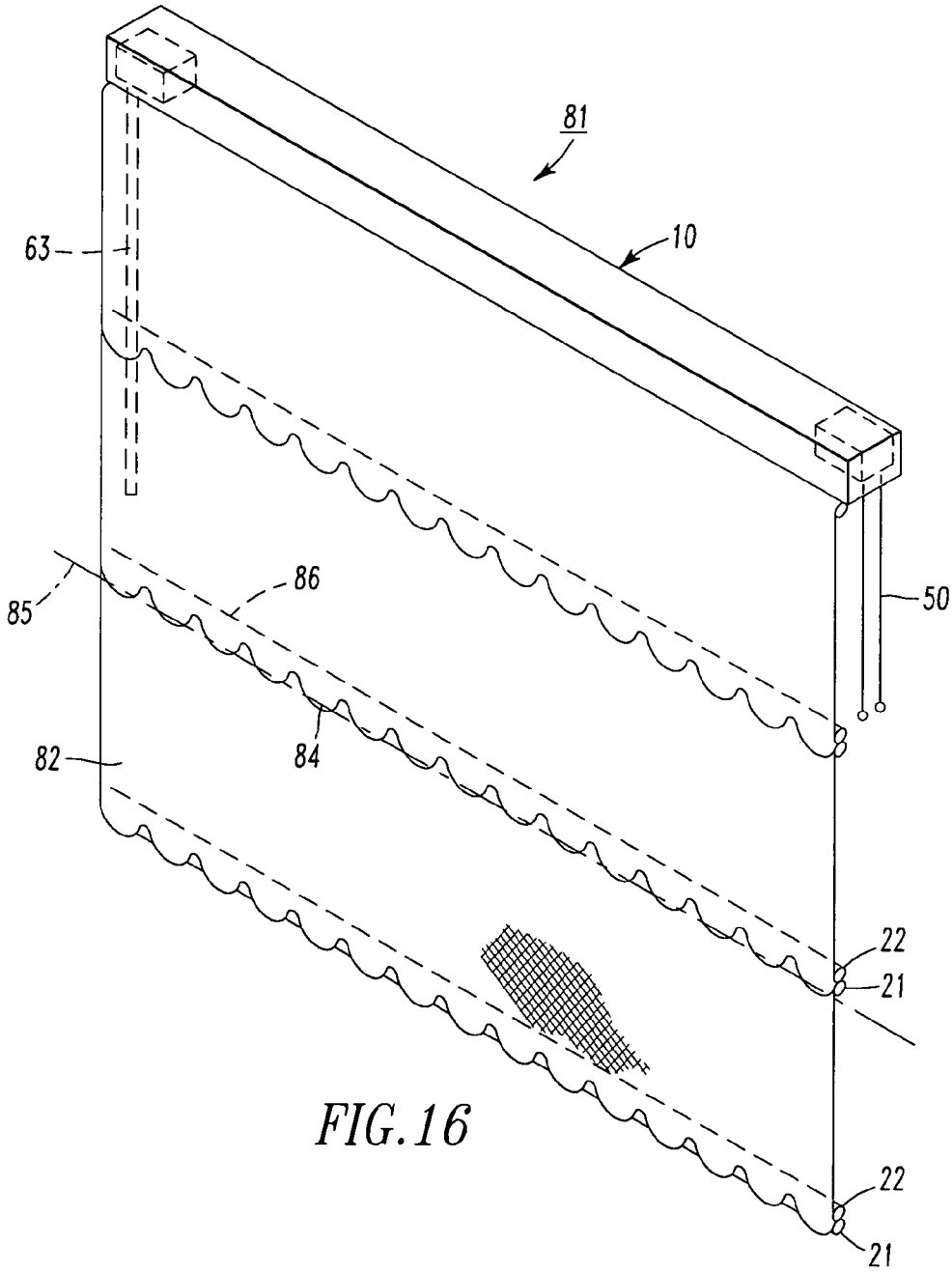
FIG. 16 is a front view of a sixth present preferred embodiment.

In all the embodiments described and illustrated to this point, the lower edge of every shade element has been a straight line. However, such a configuration is not required. The bottom edge of one or more shade elements could be curved, scalloped, or have another non-linear configuration. Moreover, a fringe could be attached to the bottom edge of one or more shade elements. Another present preferred embodiment 81 shown in FIG. 16 has several shade elements 82. In this embodiment the lower edges 84 of each shade element 82 are scalloped. As in the previous embodiments rods 21 and 22 are attached to each shade element adjacent to the upper edge and lower edge of each shade element. Since the lower edge 84 is scalloped rod 22 is positioned above the scallops so as not to be visible from the front of the shade. A line 85 tangent to the scallops is parallel to the upper edge of the shade element. Accordingly, the lower edge of the shade element can be considered to be substantially parallel to the upper edge 86 of the adjacent shade element. The embodiment shown in FIG. 16 may have the cording arrangement shown in FIGS. 2, 3 and 4 or the cording arrangement shown in FIGS. 11, 12 and 13 or any of the other cordings described in the discussion of the other embodiments. One such arrangement will include wand 63 and lift cords 50 that pass through the headrail 10.

Each of the embodiments here disclosed has a pair of lift cords, a pair of cords attached to the upper edges of the shade segment and a pair of cords attached to the lower edge of the shade segment. However, a single cord or more than two cords could be used in place of each pair of cords depending upon the size of the shade and the material used for the shade segments. One could use a tape or strip of fabric rather than a conventional cord material for the cords attached to the upper edge of the shade elements or the cords attached to the lower edge of the shade elements. The rods attached to the edges of the shade segments are preferably metal, but they could be plastic or fiberglass. The shade segments can be made of natural materials, such as silk, cotton and linen, synthetic materials, such as polyester, rayon and nylon, or a blend of natural and synthetic materials.

Although I have shown and described certain present preferred embodiments of my window covering having operable shade segments, it should be distinctly understood that the invention is not limited thereto, but may be variously embodied within the scope of the following claims.

I claim:

1. A window covering comprising:

a headrail;

a plurality of lift cords extending from the headrail;

a plurality of shade elements positioned sequentially below the headrail, the lift cords connected to at least one of the shade elements, each shade element having an upper edge and a lower edge which edges are substantially parallel to one another and oriented transverse to the lift cords;

wherein the shade elements are positioned so that when the shade elements are in a closed position the lower edge of at least one shade element abuts the upper edge of an adjacent shade element and when the shade elements are in an open position, the lower edge of the at least one shade element is spaced apart from the upper edge of an adjacent shade element;

a first cord attached to the upper edge of each shade element and extending from the headrail;

a second cord extending from the headrail and attached to the lower edge of each shade element, such that when the shade elements are in the closed position, a plane passing through the first cord and the second cord is substantially parallel to the shade elements, wherein no rungs are connected between the first cord and the second cord below a shade element;

a control mechanism connected to the headrail and connected to at least one of the first cord and the second cord; and wherein the plurality of shade elements each have a first side extending between the upper edge and the lower edge and the first side completely facing a first direction and a second side extending between the upper edge and the lower edge and the second side completely facing a second direction opposite the first direction, the shade elements, first cord and second cord being sized and positioned so that at least one of the first cord and second cord can be moved to cause the plurality of shade elements to flip to a flipped position so that when each shade element is in the flipped position the first side of each shade element completely faces the second direction and the second side of each shade element completely faces the first direction.

2. The window covering claim 1 also comprising at least one additional cord attached to the upper edge of each shade element.

3. The window covering of claim 1 also comprising at least one additional cord attached to the lower edge of each shade element.

4. The window covering of claim 1 also comprising a bottomrail to which the lift cords and one of the plurality of shade elements are attached.

5. The window covering of claim 1 wherein the control mechanism is comprised of a cord lock attached to the headrail and through which at least one of the first cord and the second cord passes.

6. The window covering of claim 1 wherein the control mechanism is comprised of a shaft within the headrail on which at least one of the first cord and the second cord is wound.

7. The window covering of claim 6 also comprising at least one spool on the shaft on which at least one of the first cord and the second cord is wound.

8. The window covering of claim 1 wherein each window shade element has a first width between the upper edge and the lower edge, and wherein the first cord and the second cord are attached to each shade element in a manner so that the upper edge and the lower edge can be moved apart from one another to a distance which is greater than the first width of the shade element.

9. The window covering of claim 1 also comprising a rod attached to the upper edge of each shade element.

10. The window covering of claim 9 wherein the rod contains at least one aperture through which one of the plurality of lift cords passes.

11. The window covering of claim 1 also comprising a rod attached to the lower edge of each shade element.

12. The window covering of claim 11 wherein the rod contains at least one aperture through which one of the plurality of lift cord passes.

13. The window covering of claim 1 wherein the plurality of shade elements are each comprised of a material selected from the group consisting of woven fabrics, non-woven fabrics, films, woven woods and woven grasses.

14. The window covering of claim 1 wherein each of the plurality of shade elements is pleated.

15. The window covering of claim 1 wherein at least one of the first cord and the second cord are a tape or a strip of fabric.

16. The window covering of claim 1 also comprising a valance attached to the headrail.

17. The window covering of claim 1 also comprising a bottom shade element to which one of the first cord and the second cord are attached.

18. The window covering of claim 1 wherein the first side differs from the second side in at least one of color, texture, pattern and material.

19. The window covering of claim 1 also comprising:

a first cord lock within the headrail and through which the first cord passes;

a second cord lock within the headrail and through which the second cord passes; and a third cord lock within the headrail and through which the plurality of lift cords pass.

20. The window covering of claim 1 comprising:

a second headrail; and a plurality of cords attached to the headrail and passing into the second headrail for raising and lowering the headrail relative to the second headrail.

21. The window covering of claim 20 also comprising a cord lock in the second headrail, the plurality of cords passing through the cord lock.

22. The window covering of claim 1 wherein the lower edge of at least one shade element of the plurality of shade elements is non-linear.

23. The window covering of claim 1 wherein the lower edge of at least one shade element of the plurality of shade elements is scalloped.

24. A window covering comprising a headrail;

a plurality of shade elements positioned sequentially below the headrail, each shade element having an upper edge and a lower edge, the upper and lower edges being substantially parallel to one another, each shade element having a first side extending between the upper edge and the lower edge and the first side completely facing a first direction and a second side extending between the upper edge and the lower edge and the second side completely facing a second direction opposite the first direction;

wherein the shade elements are positioned so that when the shade elements are in a closed position the lower edge of at least one shade element abuts the upper edge of an adjacent shade element and when the shade elements are in an open position, the lower edge of the at least one shade element is spaced apart from the upper edge of an adjacent shade element;

a first cord attached to the upper edge of each shade element and having one end attached to the headrail such that one end will always be in a fixed position relative to the headrail;

a second cord attached to the lower edge of at least one shade element and extending into the headrail, wherein no rungs are connected between the first cord and the second cord below a shade element; and a control mechanism within the headrail, the second cord attached to the control mechanism so the second cord can be moved to flip at least one shade element to a flipped position so that when that at least one shade element is in the flipped position the first side of that at least one shade element completely faces the second direction and the second side of that at least one shade element completely faces the first direction.

25. The window covering of claim 24 wherein the control mechanism is comprised of a cord lock attached to the headrail and through which the second cord passes.

26. The window covering of claim 24 wherein the control mechanism is comprised of a shaft within the headrail on which the second cord is wound.

27. The window covering of claim 26 also comprising at least one spool on the shaft on which the second cord is wound.

28. The window covering of claim 24 wherein the plurality of shade elements are each comprised of a material selected from the group consisting of woven fabrics, non-woven fabrics, films, woven woods and woven grasses.

29. The window covering of claim 24 comprising:

a second headrail; and a plurality of cords attached to the headrail and passing into the second headrail for raising and lowering the headrail relative to the second headrail.

30. The window covering of claim 29 also comprising a cord lock in the second headrail, the plurality of cords passing through the cord lock.

31. The window covering of claim 24 wherein the lower edge of the at least one shade element is non-linear.

32. The window covering of claim 24 wherein the lower edge of the at least one shade element is scalloped.

33. A window covering comprising:

a headrail;

a plurality of flexible shade elements positioned sequentially below the headrail, each shade element having an upper edge, a lower edge substantially parallel to the upper edge and a width between the upper edge and the lower edge, wherein the width of each shade element is approximately equal to the width of all other shade elements, each shade element having a first side extending between the upper edge and the lower edge and the first side completely facing a first direction and a second side extending between the upper edge and the lower edge and the second side completely facing a second direction opposite the first direction, a first cord having one end connected to the headrail and being attached to the upper edge of each shade element;

a second cord having one end connected to the headrail and being connected to the headrail in a manner so that the second cord is substantially parallel to the first cord and spaced apart from the first cord by a distance that is less than the width of the shade elements, wherein no rungs are connected between the first cord and the second cord below a shade element; and a control mechanism within the headrail connected to at least one of the first cord and the second cord, the control mechanism being configured so that at least one of the first cord and the second cord can move to flip at least one of the shade elements to a flipped position so that when that at least one shade element is in the flipped position the first side of that at least one shade element completely faces the second direction and the second side of that at least one shade element completely faces the first direction.

34. The window covering of claim 33 also comprising at least one lift cord extending from the headrail and attached to the plurality of shade elements.

35. The window covering of claim 33 wherein the control mechanism comprises a cord lock through which at least one of the first cord and the second cord passes.

36. The window covering of claim 33 wherein the control mechanism is comprised of a shaft on which at least one of the first cord and the second cord is wound.

37. The window covering of claim 36 also comprising at least one spool on the shaft on which at least one of the first cord and the second cord is wound.

38. The window covering of claim 33 wherein the plurality of shade elements are each comprised of a material selected from the group consisting of woven fabrics, non-woven fabrics, films, woven woods and woven grasses.

39. The window covering of claim 33 also comprising a valance attached to the headrail.

40. The window covering of claim 33 wherein one of the first cord and the second cord has an end attached to the headrail such that the end will always be in a fixed position relative to the headrail.

41. The window covering of claim 33 also comprising:

a first cord lock within the headrail and through which the first cord passes;

a second cord lock within the headrail and through which the second cord passes; and a third cord lock within the headrail and through which the plurality of lift cords pass.

42. The window covering of claim 33 comprising:

a second headrail; and a plurality of cords attached to the headrail and passing into the second headrail for raising and lowering the headrail relative to the second headrail.

43. The window covering of claim 42 also comprising a cord lock in the second headrail, the plurality of cords passing through the cord lock.

44. The window covering of claim 33 wherein the lower edge of the at least one shade element is non-linear.

45. The window covering of claim 33 wherein the lower edge of the at least one shade element is scalloped.

* * * * *